US008257607B1

(12) United States Patent
Johnson et al.

(10) Patent No.: US 8,257,607 B1
(45) Date of Patent: Sep. 4, 2012

(54) FLUOROCARBON-FREE, ENVIRONMENTALLY FRIENDLY, NATURAL PRODUCT-BASED, AND SAFE FIRE EXTINGUISHING AGENT

(76) Inventors: Paige Johnson, Collinsville, OK (US); Michael H. Freeman, Tulsa, OK (US); Mitchael C. Freeman, Tulsa, OK (US); Elizabeth Clagg, Claremore, OK (US)

( * ) Notice: Subject to any disclaimer, the term of this patent is extended or adjusted under 35 U.S.C. 154(b) by 0 days.

(21) Appl. No.: 13/015,266

(22) Filed: Jan. 27, 2011

Related U.S. Application Data

(63) Continuation-in-part of application No. 12/417,385, filed on Apr. 2, 2009, now abandoned, which is a continuation-in-part of application No. 12/148,225, filed on Apr. 17, 2008, now abandoned.

(60) Provisional application No. 60/923,821, filed on Apr. 17, 2007.

(51) Int. Cl.
*A62D 1/00* (2006.01)

(52) U.S. Cl. ..... 252/2; 169/46

(58) Field of Classification Search ..... 169/46; 252/2

See application file for complete search history.

(56) References Cited

U.S. PATENT DOCUMENTS

| | | | | |
|---|---|---|---|---|
| 4,459,213 | A | 7/1984 | Uchida et al. | |
| 4,865,906 | A | 9/1989 | Smith, Jr. | |
| 4,978,213 | A | 12/1990 | El Hage | |
| 5,015,466 | A | 5/1991 | Parran et al. | |
| 6,287,686 | B1 | 9/2001 | Huang et al. | |
| 6,296,781 | B1 | 10/2001 | Amiran | |
| 6,378,617 | B1 | 4/2002 | Brennan | |
| 6,612,373 | B2 | 9/2003 | Brennan | |
| 6,756,076 | B2 | 6/2004 | Brier | |
| 6,800,367 | B2 | 10/2004 | Hanyon et al. | |
| 7,087,300 | B2 | 8/2006 | Hanyon et al. | |
| 7,691,283 | B2 * | 4/2010 | Ohba et al. | 252/3 |
| 2007/0241306 | A1 | 10/2007 | Wehner et al. | |

FOREIGN PATENT DOCUMENTS

| | | |
|---|---|---|
| JP | 61-240974 | 10/1986 |
| JP | 05-171148 | 7/1993 |
| JP | 2006-130210 | 5/2006 |

* cited by examiner

*Primary Examiner* — Peter Szekely
(74) *Attorney, Agent, or Firm* — Gable Gotwals

(57) ABSTRACT

A safe, environmentally-friendly, fluorocarbon-free temperature suppressing composition includes water in combination with a sugar alcohol in solution with the water and having a general formula $H(HCHO)_{n+1}H$. Sorbitol is a preferred sugar alcohol (n=5) but sugar alcohols having n=3 to 4 or 6 to 11 may be used. The composition provides a heat absorption greater than the water alone and the sugar alcohol alone. Other sugar alcohols having the general formula $H(HCOH)_{n+1}HC$, where n=10, may also be used. The composition may further include a wetting agent, an emulsifying agent, a viscosity adjusting agent, a preservative or biocide, or a freeze suppression agent. The composition affords levels of protection suited to a variety of applications including possibility of damage from exposure to excessive heat, combustion or explosion such as may be experienced in military combat.

23 Claims, 3 Drawing Sheets

FLUOROCARBON-FREE, ENVIRONMENTALLY FRIENDLY, NATURAL PRODUCT-BASED, AND SAFE FIRE EXTINGUISHING AGENT

REFERENCE TO PENDING APPLICATIONS

This application is a continuation-in-part of, and claims priority to, U.S. Non-Provisional application Ser. No. 12/417,385, filed Apr. 2, 2009, which in turn claimed priority to U.S. Non-Provisional application Ser. No. 12/148,225, filed Apr. 17, 2008, which in turn claimed priority to U.S. Provisional Application 60/923,821, filed Apr. 17, 2007.

BACKGROUND OF THE INVENTION

This invention relates generally to temperature suppressing compositions and more particularly concerns compositions which are useful in affording some level of protection to personnel and materials from damaging external temperatures experienced as a result of exposure to excessive heat, combustion or explosion and the processes by which such compositions can be made.

The conditions under which human life and man-made materials and equipment might be damaged or destroyed in the event of exposure to excessive heat, combustion or explosion may vary considerably. Therefore, the same temperature suppressing composition will not necessarily be suited to afford protection to personnel and also to all types of material and equipment present in a potential damage incident. Sometimes, for example when military personnel, uniforms, weapons, vehicles and associated equipment are in a combat situation, the welfare of the personnel may also be dependent to significant extent on the performance of their ordinance under the potentially damaging conditions. Consequently, in the development and selection of a temperature suppressing composition, the paramount issue of welfare of personnel would not necessarily be served by ignoring the danger to the ordnance.

A still widely used, but problematic, temperature suppressing composition is aqueous film-forming foam or AFFF (commonly referred to as "A Triple F"). The AFFF composition, however, includes a toxic surfactant, fluorocarbon. Although AFFF may be mixed with water and sprayed on human skin to provide a cooling effect, AFFF's toxic characteristics prohibit this practice.

Another fluorocarbon-based composition is DUPONT™ FM-200® fire suppressant, which uses halon. Halon-based compositions are problematic because of the limited range in which the halon is effective for fire suppression, requiring roughly a 7% concentration, yet not fatal to humans, which occurs at about a 9% concentration. In a vehicle system, such as a military Humvee, the halon may prove ineffective for fire suppression because it can escape from the vehicle's interior. Furthermore, its deployment within a vehicle may cause frostbite on the face and eyes and requires a level of force which may prove injurious to humans, rupturing eardrums and breaking jawbones. Halon, even at low concentrations, can be fatal to humans if inhaled during an excited state typical of that experienced by military personnel when their vehicle is under enemy fire or after it has hit an improvised explosive device. Because of these known problems, military personnel sometimes disable the halon systems in their vehicles.

U.S. Pat. No. 6,296,781 describes a fire retardant and extinguishing composition which is basically an admixture of emollient, emulsifier and dispersant in a water carrier, to which an oxygen competitor, a coolant, a radical scavenger and/or an oxygen depleting compound may be added. It is intended to lower the temperature of burning material more effectively than water alone and to compete for oxygen so as to counteract flash point and flame-yielding oxidation. This composition affords no char function or humectant cooling effect. Its surfactant content is insufficient to promote sufficient all-stage homogeneity to avoid layering during storage. While it uses sodium polyacrylate, the sodium polyacrylate is used as a wetting and penetrating agent rather than for providing an insulating barrier. Its theory of flame retardation is based on protein use and the resulting changes in chemical status. The use of proteins, however, imposes a limited shelf life on the composition.

One previously marketed temperature suppressing composition includes water, water-soluble nitrogen, ultra-hydrocarbon surfactant, ethylene glycol, a sugar alcohol (sorbitol) and an acrylic thickener. However, this known composition, while effective for some applications, does not afford the desired level of protection for other applications. Furthermore, the proportionate relationship of the components requires relatively large volumes of composition for a given application. Further, some of the components are not sufficiently protective to human skin or friendly to the environment.

Other temperature suppressing compositions include a sugar alcohol but fall into one of three categories: (1) use the sugar alcohol in combination with a organic halides like fluorocarbons and halogenated hydrocarbons; (2) require the composition to cure or use a resin-like material to retard but not suppress fire; or (3) maintain the sugar alcohol in solid form for use as a water-soluble release agent. Examples of compositions in the first category, organic-halide based, are U.S. Pat. No. 4,459,213 to Uchida et al. and JP 61240974 to Inoue. Uchida et al. requires a halogenated hydrocarbon and Inoue require fluorocarbon compounds and perchlrocarbon compounds Examples of compositions in the second category, fire-retardant cured- or resin-based compositions, are JP 05171148 to Kenzai and JP 20066130210 to Hatsuda. Kenzai is interested in providing a flame-resistant or flame-retardant material and not a temperature suppressing composition that is applied to a fire. The composition must cure to form a stone-like substance when heated to 80-90° C. (about 170-190° F.). Because Kenzai's sugar alcohol is used as a reactant to form a solid flame-resistant, stone-like product, the sugar alcohol is no longer a sugar alcohol in the final product. Further, his composition would not remain fluid when exposed to the heat generated by a typical fire. Hatsuda is similar to Kenzai in that Hatsuda appears to be using sugar alcohol as a reactant. Hatsuda seems to require a chemical reaction between a base (alkali metal salt) and an acid (sugar alcohol) to form a base resin that is dissolved in water.

An example of compositions in the third category, solid sugar alcohol-based, is U.S. Pat. No. 4,978,460 to Von Blucher. Von Blucher discloses a solid powder sugar or sugar derivative for use as a water-soluble release agent which prevents swelling of a gelatinizing agent. If the gelatinizing agent goes into the water as a solid, the release agent must also go into the water as a solid if it is to accomplish Von Blucher purpose. A finely ground material is not an aqueous solution, and the method for applying a finely ground material into a water stream is not the same as a method for applying an already aqueous solution to a fire. Additionally, Von Blucher's solid release agent is not capable of being substantially instantaneously deployed in response to a fire event. Rather, it requires mixing energy to be provided, which results in an unacceptable amount of residence time. Because of the relationship between time and temperature in a fire, time is of the essence in fire suppression. It almost goes without saying that any amount of time, regardless of how short it might be, is an eternity to a person who is being burned by fire.

SUMMARY OF THE INVENTION

In accordance with the invention, a temperature suppressing composition is provided which is useful in affording some level of protection to personnel and materials from damaging external temperatures experienced as a result of exposure to excessive heat, combustion or explosion, and which is environmentally friendly and based on natural products. The claimed composition (1) is fluorocarbon-free and halon-free; (2) includes at least one solubized sugar alcohol which remains as a solubized sugar alcohol as it is being deployed from a storage means; (3) is stored in and deployed from conventional storage means typical of the kind used to store and deploy liquid temperature suppressing compositions; and (4) is substantially instantaneously deployed from its storage means and without the need for explosive forces typical of those used to deploy fluorocarbon- and halon-based compositions.

The fluourcarbon-free temperature suppressing composition includes water, preferably de-ionized, and a sugar alcohol having the general formula, $H(HCOH)_{n+1}H$. The preferred sugar alcohol is sorbitol but other sugar alcohols similar in structure to sorbitol —$H(HCOH)_{n+1}H$, where n=5—may be substituted for sorbitol. These sugar alcohols include dulcitol, iditol and mannitol. Furthermore, other sugar alcohols having the general formula $H(HCOH)_{n+1}H$, where n=3 or 4, may be used. These sugar alcohols include erythritol, threitol, arabitol, ribotol, and xylitol. Other sugar alcohols having the general formula $H(HCOH)_{n+1}H$, where n=6 to 11, may also be employed. Still other sugar alcohols having the general formula $H(HCOH)_{n+1}HC$, where n=10, may also be used. This group of sugar alcohols includes isomalt, lactitol and maltitol. Two or more sugar alcohols may be used in combination or hydrogenated starch hydrolysates, a group of commercial products that contain a broad group of sugar alcohols, may be used.

The sugar alcohol and water composition has a heat absorption greater than the sugar alcohol alone and the water alone. Again, the sugar alcohol remains solubized in the water as the temperature suppressing composition remains in storage and ready for deployment. In one embodiment, the sugar alcohol is in a range of 7 to 70% of the total quantity of the temperature suppressing composition by weight. In another embodiment, the sugar alcohol is in a range of 70 to 83% of the total quantity of the temperature suppressing composition by weight. In yet another embodiment, the sugar alcohol is in a range of 65 to 70% of the total quantity of the temperature suppressing composition by weight.

The composition may also include an emulsifying agent, a viscosity adjusting agent, a wetting agent, a freeze point suppression agent, or a preservative agent. In one embodiment, the wetting agent is ammonium lauryl sulfate, the viscosity adjusting agent is xanthan gum, and the freeze point suppression agent is propylene glycol. The ammonium lauryl sulfate is preferably in a range of 2 to 2.5 percent of the total quantity of the temperature suppressing composition by weight, with the xanthan gum and propylene glycol at about 0.1% and 1%, respectively, of the total quantity of the temperature suppressing composition by weight. Last, the composition may include aloe.

A method for suppressing a fire includes the step of applying a composition of sugar alcohol and water, preferably de-ionized water, to a physical object or person at risk because of the fire. The sugar alcohol, which is in solution with the water, remains as a sugar alcohol during the applying step. In one embodiment, the amount of sugar alcohol is in a range of 7 to 70% of the total quantity of the temperature suppressing composition by weight. In another embodiment, the sugar alcohol is in a range of 70 to 83% of the total quantity of the temperature suppressing composition by weight. In yet another embodiment, the sugar alcohol is in a range of 65 to 70% of the total quantity of the temperature suppressing composition by weight. In another embodiment, the sugar alcohol is in a range of 0.1 to 7% of the total quantity of the temperature suppressing composition by weight. Objects of this invention are to provide a temperature suppressing composition that:

1) is effective in suppressing fire events and, in particular, suppressing fire events likely to be encountered during military operations;
2) is effective for use across fire classes;
3) is organic-halide free and, more specifically, fluorocarbon-free and halon-free;
4) is natural-product based and safe to the environment;
5) is safe to deploy around humans;
6) deploys without requiring the explosive forces typical of those used to deploy fluorocarbon- and halon-based compositions;
7) is safe to ingest in limited quantities;
8) remains in an aqueous state as it is being deployed from its storage means in response to a fire event;
9) does not produce any acid gases when exposed to the high heat and temperatures associated with fire events;
10) instantaneously deploys from storage means typically used in fire suppression systems—including but not limited to fire extinguishers, extinguisher backpacks, holding tanks, and building and vehicle fire suppression piping systems—without the need for the high forces required by fluorocarbon- and halon-based compositions like AFFF and DUPONT™ FM-200®' and
11) can be stored for relatively long periods of time and in a wide range of temperature conditions yet retain its fire suppression characteristics and remain in a immediately deployable state.

BRIEF DESCRIPTION OF THE DRAWINGS

Other objects and advantages of the invention will become apparent upon reading the following detailed description and upon reference to the drawings in which.

Figure 1:
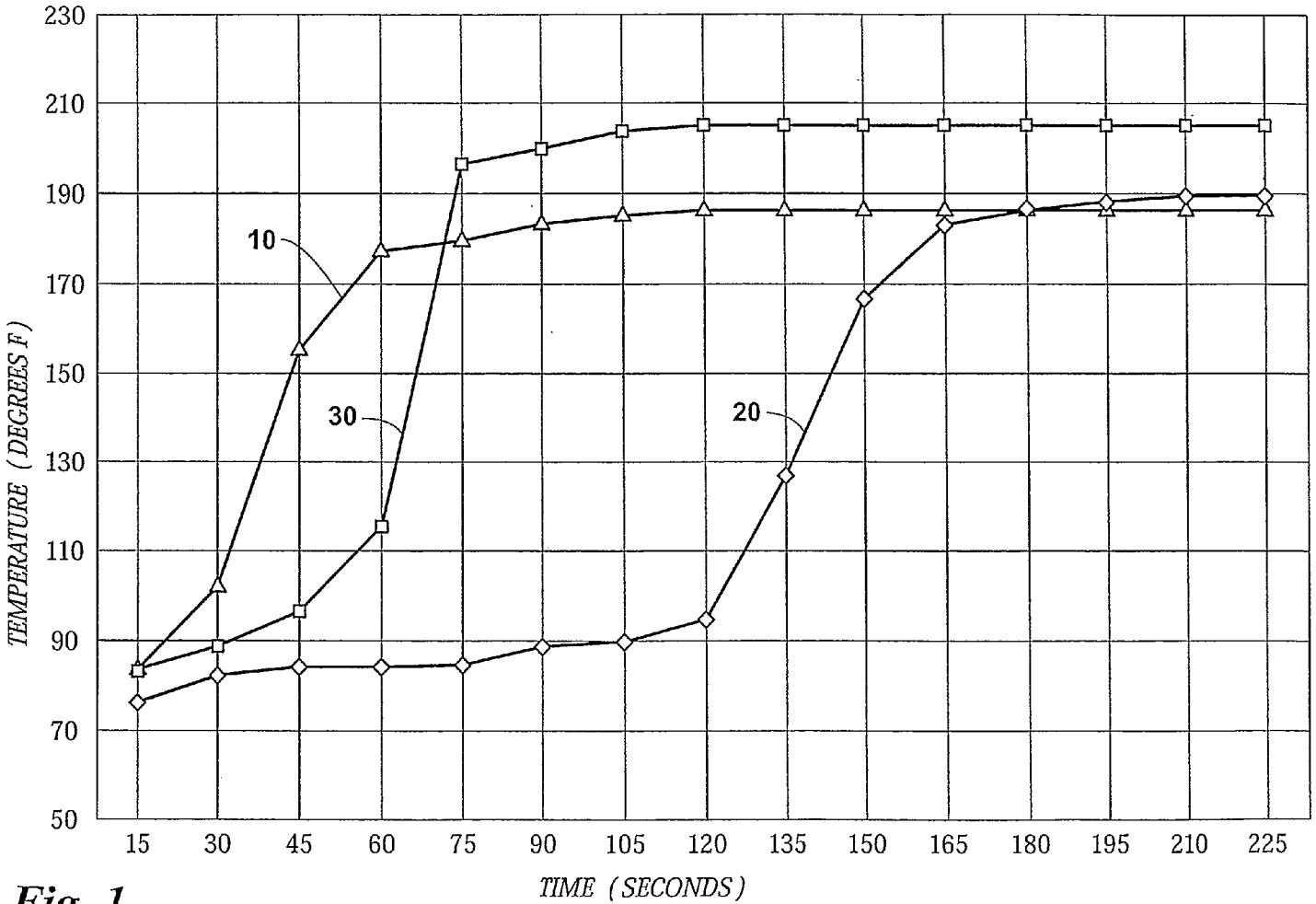
FIG. 1 is a graphical comparison of the temperature/time characteristics of a preferred embodiment of the composition in 2-to-1 and 4-to-1 ratios to water alone in response to heat applied to cotton-polyester material coated with the composition.

While the invention will be described in connection with several preferred embodiments of the composition thereof, it will be understood that it is not intended to limit the invention to those embodiments or to the details of the accompanying drawings.

DETAILED DESCRIPTION

A person of ordinary skill in the art will recognize that the inventors are critical of fluorocarbon-based and halon-based temperature suppressing compositions in the Background section and that all of the preferred embodiments disclosed herein are organic halide-free, organofluorine-free, fluorocarbon-free and halon-free. A person of ordinary skill also knows that the classes of fluorocarbons and halons overlap, but not completely. There are many fluorocarbons that are not halons. TEFLON® (DuPont) is one example. There are a few halons that are not fluorocarbons, namely:

Methyl iodide or iodomethane—proposed by some as a fire extinguishing agent;

Bromomethane—toxic and regulated as a pesticide;

Bromochloromethane—banned for use in fire extinguishers in 1969;

Carbon tetrachloride—carcinogenic.

Therefore, throughout this disclosure "fluorocarbon- and halon-free" is used as shorthand for fluorocarbon-free, halon-free, or fluorocarbon- and halon-free. In other words, the inventors seek to avoid those types of compounds in a temperature suppressing composition made according to this invention.

A person of ordinary skill also knows that fluorocarbons and halons are organic-halides and will recognize that the inventors wish to avoid the use of organic halides in the claimed temperature suppressing composition. One embodiment discloses the use of triclosan (2,4,4'-trichloro-2'-hydroxydiphenyl ether), which some in the art might consider to be an organic-halide, but most, including the inventors, consider to be organic aromatic compound. Because of recent safety concerns with triclosan, it is not preferred that triclosan be included in a temperature suppressing composition made according to this invention.

Fluorocarbon-Free Water-Soluble Nitrogen Compositions

The basic components of a temperature suppressing composition which is useful in affording some level of protection to personnel and materials from damaging external temperatures experienced as a result of exposure to excessive heat, combustion or explosion are water, water soluble nitrogen (i.e., $CO(NH_2)_2$, also known as urea), either an "ultra-hydrocarbon surfactant" or a non-nonyl phenolic blend of non-ionic and anionic surfactants, either ethylene glycol or propylene glycol, sorbitol and viscosity increasing sodium polyacrylate. The term, "ultra-hydrocarbon surfactant" is a surfactant that includes amines but also mostly hydrocarbons. One example of this type of surfactant is EAGLEADD™ surfactant sold by Eagle Performance Products (Calhoun, Ga.).

While the water functions primarily as a carrier, de-ionized or purified water is preferred so that, if personnel experience burns, faster healing may be fostered than will likely be experienced if tap water containing chlorine and fluorides is used. Nitrogen functions as a humectant, allowing treated materials to retain moisture and delays the flame response time. It works in the vapor stage of flame suppression and helps to form a char barrier that provides a thermal barrier for coated equipment and other objects. The use of the non-nonyl phenolic blend of non-ionic and anionic surfactants is preferred as a wetting agent and surface tension reducer because it promotes homogeneity of the composition at all stages of its use. The use of propylene glycol affords freeze protection and improves the discharge characteristics of the composition. Sorbitol is thought to facilitate easy flow of the composition and, when used in greater proportions, film more quickly so as to form an insulating barrier on treated equipment and personnel. Viscosity increasing sodium polyacrylate, which adds body to the composition, works better in water than previously used acrylic thickeners.

In a first embodiment, for applications such as for most surface vehicle applications, for example, the surfactant to water weight ratio is in a range of approximately 0.2 to 0.85, the sorbitol to total composition weight ratio is in a range of approximately 0.1 to 0.6, the nitrogen to water weight ratio is in a range of approximately 0.25 to 0.95, the ethylene glycol to water weight ratio in a range of approximately 0.03 to 0.12 and the sodium polyacrylate to water weight ratio is in a range of approximately 0.1 to 0.6. Optimally, the surfactant to sorbitol weight ratio will be approximately 1. For example, one satisfactorily tested composition has a surfactant weight ratio of 0.54, a sorbitol weight ratio of 0.2, a nitrogen weight ratio of 0.55, an ethylene glycol weight ratio of 0.09 and a sodium polyacrylate weight ratio of 0.21.

In a second embodiment, the composition may also include potassium acetate. For steel industry and forestry applications, for example, the potassium acetate to water weight ratio is in a range of approximately 2.2 to 12.5, the surfactant to water weight ratio is in a range of approximately 0.15 to 0.95, the sorbitol to total composition weight ratio is in a range of approximately 0.025 to 0.18, the nitrogen to water weight ratio is in a range of approximately 0.2 to 0.95, the ethylene glycol to water weight ratio is in a range of approximately 0.02 to 0.18 and the sodium polyacrylate to water weight ratio is in a range of approximately 0.35 to 1.5. Optimally, the surfactant to sorbitol weight ratio will be approximately 1. For example, one satisfactorily tested composition has a potassium acetate weight ratio of 6.97, a surfactant weight ratio of 0.54, a sorbitol weight ratio of 0.575, a nitrogen weight ratio of 0.55, an ethylene glycol weight ratio of 0.09 and a sodium polyacrylate weight ratio of 0.63.

In a third embodiment, for government and military vehicles such as humvees, for example, the composition surfactant to water weight ratio is in a range of approximately 0.5 to 7.5, the sorbitol to total composition weight ratio is in a range of approximately 0.15 to 0.65, the nitrogen to water weight ratio is in a range of approximately 1.2 to 6.5, the propylene glycol to water weight ratio is in a range of approximately 0.15 to 0.95 and the sodium polyacrylate to water weight ratio is in a range of approximately 0.4 to 4.5. For example, one satisfactorily tested composition has a surfactant weight ratio of 3.11, a sorbitol weight ratio of 0.277, a nitrogen weight ratio of 3.2, a propylene glycol weight ratio of 0.52 and a sodium polyacrylate weight ratio of 1.21. In this embodiment, for applications such as personnel carriers, for example, the composition surfactant to water weight ratio is in a range of approximately 0.5 to 7.5, the sorbitol to total composition weight ratio is in a range of approximately 0.15 to 0.65, the nitrogen to water weight ratio is in a range of approximately 1.2 to 6.5, the propylene glycol to water weight ratio is in a range of approximately 0.75 to 6.5 and the sodium polyacrylate to water weight ratio is in a range of approximately 2.5 to 12.5. Optimally, the surfactant to sorbitol weight ratio will be approximately 1. For example, one satisfactorily tested composition has a surfactant weight ratio of 3.11, a sorbitol weight ratio of 0.277, a nitrogen weight ratio of 3.2, a propylene glycol weight ratio of 3.45 and a sodium polyacrylate weight ratio of 5.12.

In a fourth embodiment, the composition may also include aloe. For applications involving personal safety and human body contact, the composition aloe to water weight ratio is in a range of approximately 0.01 to 4.0, the sodium polyacrylate to water weight ratio is in a range of approximately 0.5 to 3.5 and the propylene glycol to water weight ratio is in a range of approximately 2.0 to 6.5. Optimally, the surfactant to sorbitol weight ratio will be approximately 1. For example, one satisfactorily tested composition has an aloe weight ratio of 0.02, a surfactant weight ratio of 3.11, a sorbitol weight ratio of 0.277, a nitrogen weight ratio of 3.2, a propylene glycol weight ratio of 3.45 and a sodium polyacrylate weight ratio of 1.21.

Process for Making Embodiments of the Water-Soluble Nitrogen Compositions

The process for making the first embodiment of the temperature suppressing composition includes the steps of mixing water continuously at a temperature in a range of from 45° F. to 120° F. to maintain a vortex, adding the ethylene glycol to the vortex, approximately 5 to 30 minutes after adding the ethylene glycol, adding the sorbitol to the vortex, approximately 5 to 30 minutes after adding the sorbitol, adding water soluble nitrogen to the vortex, after all the nitrogen is dissolved, adding the ultra-hydrocarbon surfactant to the vortex, approximately 15 to 45 minutes after adding the surfactant, simultaneously slowly adding viscosity increasing sodium polyacrylate to and increasing agitation of the vortex, after adding the sodium polyacrylate, increasing agitation of the vortex as needed to blend the mixture, approximately 20 to 40 minutes after the adding sodium polyacrylate, if the viscosity of the mixture is too low, simultaneously slowly adding additional viscosity increasing sodium polyacrylate to the vortex and approximately 10 to 30 minutes after adding any additional sodium polyacrylate, if the viscosity of the mixture is still too low, again simultaneously slowly adding additional viscosity increasing sodium polyacrylate to the vortex, repeating this step until the viscosity of the mixture is within a predetermined range. In performance of the process, the quantity of ethylene glycol added is in a range of approximately 6% to 20% of the quantity of water by weight, the quantity of sorbitol added is in a range of approximately 15% to 40% of the total quantity of the composition by weight, the quantity of water soluble nitrogen added is approximately 45% to 75% of the quantity of water by weight, the quantity of ultra-hydrocarbon surfactant added is approximately 40% to 78% of the quantity of water by weight and the quantity of viscosity increasing sodium polyacrylate added is approximately 16% to 30% of the quantity of water by weight. The process may further include the steps of adding color and scent to the vortex after viscosity within the predetermined range is achieved and continuing mixing for at least 10 minutes, the quantity of color and scent added being approximately 0.02% to 0.10% of the quantity of water by weight.

The process for making the second embodiment of the temperature suppressing composition includes the steps of mixing the first embodiment of the composition continuously at a temperature in a range of from 45° F. to 120° F. to maintain a vortex, adding the potassium acetate to the vortex, approximately 15 to 30 minutes after adding the potassium acetate, simultaneously slowly adding the viscosity increasing sodium polyacrylate to and increasing agitation of the vortex, after adding the sodium polyacrylate, increasing agitation of the vortex as needed to blend the mixture, approximately 20 to 40 minutes after adding the sodium polyacrylate, if the viscosity of the mixture is too low, simultaneously slowly adding additional viscosity increasing sodium polyacrylate to the vortex and approximately 10 to 30 minutes after adding any additional sodium polyacrylate, if the viscosity of the mixture is still too low, again simultaneously slowly adding additional viscosity increasing sodium polyacrylate to the vortex, repeating this step until the viscosity of the mixture is within a predetermined range. In performance of the process, the quantity of viscosity increasing sodium polyacrylate added is approximately 36% to 56% of the quantity of water by weight in the vortex and the quantity of potassium acetate added is approximately 600% to 800% of the quantity of water by weight in the vortex.

The process for making the third embodiment of the temperature suppressing composition includes the steps of mixing the de-ionized water continuously at a temperature in a range of from 45° F. to 120° F. to maintain a vortex, adding the propylene glycol to the vortex, approximately 5 to 15 minutes after adding the propylene glycol, adding the sorbitol to the vortex, approximately 5 to 15 minutes after adding the sorbitol, adding the water soluble nitrogen to the vortex, after all the nitrogen is dissolved, adding the non-nonyl phenolic blend of non-ionic and anionic surfactants to the vortex, approximately 15 to 30 minutes after adding the surfactant blend, simultaneously slowly adding the viscosity increasing sodium polyacrylate to and increasing agitation of the vortex, after adding the sodium polyacrylate, increasing agitation of the vortex as needed to blend the mixture, approximately 20 to 40 minutes after adding the sodium polyacrylate, if the viscosity of the mixture is too low, simultaneously slowly adding additional viscosity increasing sodium polyacrylate to the vortex and approximately 10 to 20 minutes after adding any additional sodium polyacrylate, if the viscosity of the mixture is still too low, again simultaneously slowly adding additional viscosity increasing sodium polyacrylate to the vortex, repeating this step until the viscosity of the mixture is within a predetermined range. In performance of the process, the quantity of propylene glycol added is in a range of approximately 46% to 66% of the quantity of water by weight, the quantity of sorbitol added is in a range of approximately 300% to 400% of the total quantity of the composition by weight, the quantity of water soluble nitrogen added is approximately 270% to 470% of the quantity of water by weight, the quantity of surfactant blend added being approximately 280% to 360% of the quantity of water by weight and the quantity of viscosity increasing sodium polyacrylate added is approximately 100% to 150% of the quantity of water by weight. The process may further include the steps of adding color and scent to the vortex after viscosity within the predetermined range is achieved and continuing mixing for at least 10 minutes, the quantity of color and scent added being approximately 0.18% to 0.40% of the quantity of water by weight.

The process for making the fourth embodiment of the temperature suppressing composition includes the steps of mixing the third embodiment of the composition continuously at a temperature in a range of from 45° F. to 120° F. to maintain a vortex, adding the propylene glycol to the vortex, approximately 5 to 15 minutes after adding the propylene glycol, adding the aloe to the vortex, approximately 15 to 45 minutes after adding the aloe, simultaneously slowly adding the viscosity increasing sodium polyacrylate to and increasing agitation of the vortex, after adding the sodium polyacrylate, increasing agitation of the vortex as needed to blend the mixture, approximately 20 to 45 minutes after adding the sodium polyacrylate, if the viscosity of the mixture is too low, simultaneously slowly adding additional viscosity increasing sodium polyacrylate to the vortex and approximately 10 to 20 minutes after adding any additional sodium polyacrylate, if the viscosity of the mixture is still too low, again simultaneously slowly adding additional viscosity increasing sodium polyacrylate to the vortex, repeating this step until the viscosity of the mixture is within a predetermined range. In performance of the process, the quantity of propylene glycol added is approximately 270% to 350% of the quantity of water by weight in the vortex, the quantity of aloe added is approximately 17% to 25% of the quantity of water by weight in the vortex and the quantity of viscosity increasing sodium polyacrylate added is approximately 375% to 450% of the quantity of water by weight in the vortex. The process may further include the steps of adding color and scent to the vortex after viscosity within the predetermined range is achieved and continuing mixing for at least 10 minutes, the quantity of color and scent added being approximately 0.15% to 0.65% of the quantity of water by weight.

A comment is in order here with respect to the terms, slowly, increasing agitation, and predetermined range. The expressions "slowly" and "increasing agitation" are tied to a specific result, namely, blending the mixture. If the mixture is not blended, the speed or rate at which the components are being added must be decreased or agitation must be increased (or some combination thereof) until the mixture becomes blended. Therefore, a person of ordinary skill would not need to engage in undue experimentation in order to determine what pour rate or level of increased agitation is needed to blend the mixture anymore than would a person using a household blender need undue experimentation to determine the speed required to blend a particular powder into a liquid.

In regards to "predetermined range," a person of ordinary skill in the art understands that the desired viscosity of a temperature suppressing composition depends upon such factors as the delivery means and the environment in which the composition is to be stored and deployed. For example, a different viscosity is required if the composition is being delivered through a large diameter hose or a fine sprayer, or being applied at temperatures significantly below or above freezing. Therefore, the predetermined range is the desired viscosity of the temperature suppressing composition as determined by the user for his or her particular intended application.

A user making the composition according to the claimed method would continue adding viscosity increasing sodium polyacrylate to the vortex as needed until the viscosity of the mixture is within the user's predetermined range.

Performance of the Water-Soluble Nitrogen Compositions

Turning first to FIG. 1, the fourth embodiment of the composition is compared, for purposes of example, to water. Cotton-polyester material wet with the composition were positioned between a heat gun and an IR thermometer with the thermometer and the gun aimed at the same point on the wet fabric. With the heat gun set to a high setting, a timer was started and the temperature recorded at 15 second intervals for 225 seconds. Identical tests were performed using water 10 as the wetting agent, composition in a 2-to-1 ratio 20 and composition in a 4-to-1 ratio 30 with deionized water as the diluting agent. This graph illustrates that in the first minute of operation, both composition ratios were more effective than water. The 2-to-1 composition was more effective than the 4-to-1 composition.

Figure 2:
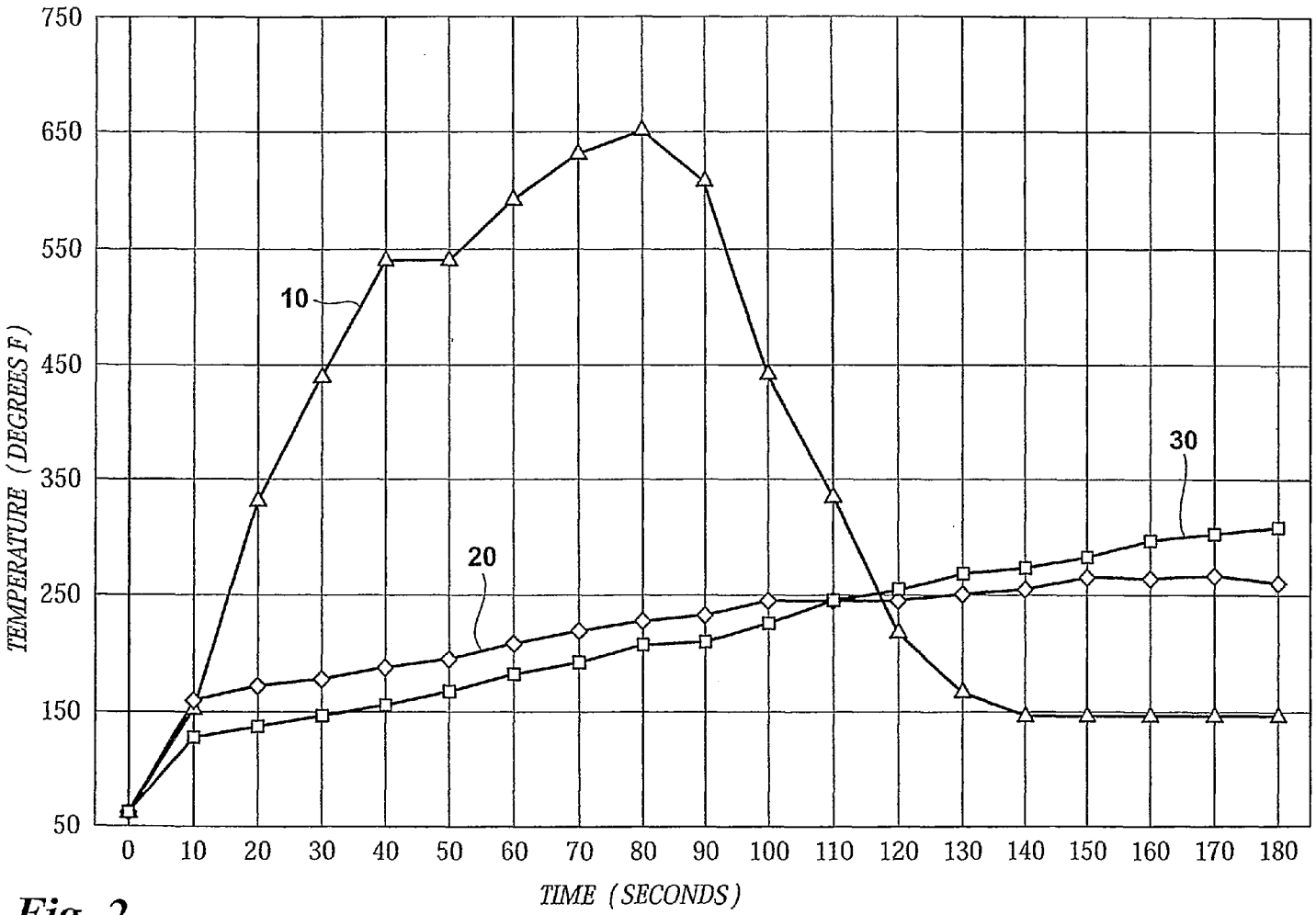
FIG. 2 is a graphical comparison of the temperature/time characteristics of the compositions and water of FIG. 1 in response to an open flame applied to pork coated with the composition.

However, looking at FIG. 2, the fourth embodiment of the composition is again compared, for purposes of example, to water. In this comparison, ten millimeter thick pieces of pork wet with the composition were positioned between an open flame and the IR thermometer with the thermometer and the flame aimed at the same point on the same side of the wet pork. The flame temperature at the point of ignition was 650 degrees. A timer was started and the temperature recorded at 10 second intervals for a period of 180 seconds. Identical tests were performed using water 10 as the wetting agent, composition in a 2-to-1 ratio 20 and composition in a 4-to-1 ratio 30 with deionized water as the diluting agent. This graph illustrates that the compositions 20 and 30 are far more effective than water 10.

The compositions 20 and 30 are relatively close in their tracking although, prior to the 105 second point, the 4-to-1 composition 30 maintained lower temperatures on the surface of the pork than the 2-to-1 composition 20. Looking further at the graph of FIG. 2, the temperature of the pork treated with the 4-to-1 composition 30 always increases, though to varying degrees, while the temperature of the pork treated with the 2-to-1 composition 20 sometimes decreases, as appears at the 105 and 150 second intervals. The decrease in temperature is a result of charring of the pork.

The insulating effect of the charring results in a temporary cooling which is overcome at the 115 and 155 second intervals when the charring has broken down. While it is desirable to have a charring effect on equipment and other materials to create this insulation barrier, charring of human skin is not desirable. Therefore, the 4-to-1 ratio composition 30 over a three minute interval provides protection for personnel than the 2-to-1 ratio composition 20. Furthermore, while the 2-to-1 ratio composition 20 is more effective on material, this is, insofar as personnel are concerned, outweighed by the physical means of the personnel which are better served by both the functionality and the lower costs afforded by the 4-to-1 composition 30.

The composition was also tested on rubber motor vehicle tires. Tires were secured to the test structure and an accelerant, a 50/50 mixture of kerosene and diesel fuel, was applied directly to the tires prior to ignition. Additional accelerant was applied after the test was initiated to increase the combustion of the tires. After allowing the tires to burn for sufficient time to insure that the rubber was on fire and that the flames were not simply emanating from the combustion of the accelerant, extinguishers disbursed composition on the tires.

In a first test, the fire was totally extinguished within 50 seconds after initiation of application of the composition. Two extinguishers were used, one for each of two tires, applying a total of 11 pounds or 1.22 gallons of the composition to completely extinguish the fire and cool the tires. In the first test, a significant amount of this volume was applied after the fire was completely extinguished to assure the test personnel that the tires and rims were cool to the touch of bare hands.

In a second test, one tire and one extinguisher containing the composition were used. An additional 0.1 gallons of diesel fuel was poured into a pan under the tire to initiate the fire. After allowing the tire to burn for a sufficient time to assure that the flames were from the combustion of the tires rather than the accelerant, the fire was extinguished within 20 seconds of initiation of application of the composition and test personnel were immediately able to touch the tire with bare hands.

In a third test, two tires and two extinguishers were used and, when sufficient time had elapsed to assure that the rubber of the tires was on fire, the fire was totally extinguished in less than 15 seconds after initiation of application of the composition. On one tire, 6 pounds of composition were used to completely extinguish the fire. On the other tire, 15.5 pounds was used to both extinguish the fire on the second tire and to cool both tires and both rims. Of the total 21.5 pounds, or 2.39 gallons of composition, the majority was applied after the fire was completely extinguished to cool the tires and the rims so that the test personnel were immediately able to touch the tires with their bare hands. The reduced time in sequential tests is the result of precautions by test personnel and their personal assurance of the effectiveness of the composition in cooling the burned tires sufficiently to be touched.

These tests are a demonstration of the effectiveness of the composition of the 4-to-1 ratio composition on materials and objects in light of FIG. 1 supporting an ultimate decision for use of a 4-to-1 composition 30 when personnel may be endangered.

The balance and proportions of the film forming and char forming chemistry of the composition offer a level of protection for both exposed body portions of personnel and their clothing as well as their equipment. They are safe to use while also very effective as a flame extinguishing medium. The composition is more stable over time than previously marketed products. The composition is not negatively influenced by bacterial attack or corrosion. The concentration and balance of the composition allow for a practical storage-discharge system which can carry a useful quantity of composition without need for a storage-discharge unit of undue weight and size. The use of aloe as a homeopathic additive, rather than proteins, starches or sugars which can contaminate burns and detract from the healing process, aids in healing burn damage to human skin. The composition contains no solvents other than water. It is homogeneous, reducing the likelihood of settling or layering in storage.

Fluorocarbon-Free, Environmentally Friendlier, Safer Compositions

Although the water-soluble nitrogen composition was believed to contain no hazardous ingredients, volatile organic compounds or hazardous air pollutants, it was later learned that the sodium polyacrylate produced small quantities of a toxic gas, acrolein, during combustion. The nitrogen, which was thought necessary for char formation, produced ammonia gas during combustion. The ethylene glycol is also a known human toxin. There is a need, therefore, for a temperature suppression composition that is safer to humans and more environmentally friendly while still being effective in suppressing fire in a wide variety of applications.

Subsequent testing of the water-soluble nitrogen-based compositions determined that sorbitol is primarily responsible for the heat absorption capability of the composition. This result may be due to sorbitol's extensive hydrogen-bonding capability. Furthermore, the addition of water-soluble nitrogen or urea—which was thought to improve heat absorption capability because of its char forming effect—reduces the heat absorption capability because it reacts with the sorbitol, thereby interfering with the sorbitol-water interactions.

Figure 3:
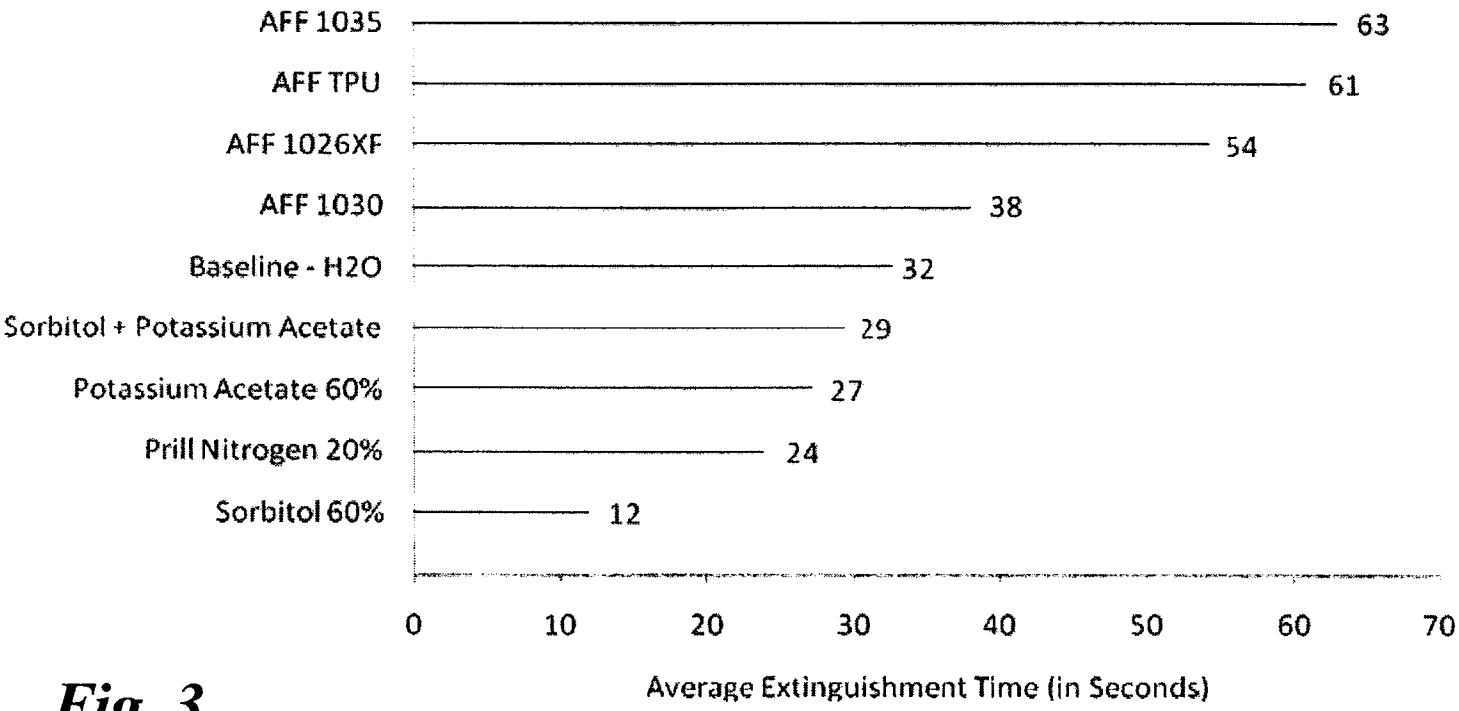
FIG. 3 is graphical comparison of the average time required by water, a 60% sorbitol solution (the sorbitol being in solution with the water), and other compositions to extinguish a five-gram magnesium fire.

FIG. 3 presents the results of a magnesium fire test. A base plate of steel was used as the table in this experiment. The steel plate was ¼"×24"×36" with a drain hole on one end of the plate. A ¼"×2" 90 degree-edge was welded around the perimeter of the plate to contain excess splatter. A five (5) gram mound of magnesium was placed on the steel plate about 6" from each side of one corner. The magnesium was ignited and allowed to burn for about seven (7) seconds. At that time extinguishment was begun using a one-quart spray mist bottle filled with the appropriate test specimen. Each of the test specimens which include "AFF" in their title included a solubized sugar alcohol, namely sorbitol, as did those which include sorbitol in the title. A person of ordinary skill would understand that a solubized sugar alcohol deployed from a spray bottle (or a fire extinguisher) does not undergo any physical transformation as it travels from the storage means to the nozzle of the bottle or extinguisher. The spray pattern varied depending on the viscosity of the solution, the higher viscosity solution forming more of a stream than a mist. The extinguishment time and the flare-up size of the magnesium fire were noted. The water only composition produced a large flare-up, the remaining compositions produced a small flare-up.

The sorbitol solution extinguished the magnesium fire at least twice as fast as the other tested solutions. These test results suggest that the temperature suppressing characteristic is degraded by the addition of nitrogen, which was believed to enhance temperature suppression via char formation, and other components believed necessary for temperature suppression performance. For example, the water-soluble nitrogen compositions—ARCTIC FIRE FREEZE™ (Global Safety Labs, Inc., Tulsa, Okla.) AFF-1026×F, which is formulated for fuel fires, AFF-1030, which is formulated for general purpose applications, AFF-1035, which is optimized for magnesium fires, and TPU, a version formulated for table-top demonstrations—all contain water; water soluble nitrogen, a non-nonyl phenolic blend of non-ionic and anionic surfactants, propylene glycol; film-forming sorbitol; and viscosity increasing sodium polyacrylate. Although these compositions are effective for fire suppression, the 60% sorbitol solution extinguished the magnesium fire three to five times faster on average than these compositions.

Sorbitol's effectiveness as a fire-fighting agent is due to its ability to absorb heat when in aqueous solution. Differential scanning calorimetry analysis of a series of sorbitol concentrations ranging from 0.1 to 83% by weight show that all have a greater heat absorption than does water alone, averaging a 300% increase in heat absorption. In addition, some concentrations of sorbitol, particularly those in the range of 60 to 70%, have freeze-protection properties, remaining pourable at temperatures below −51° C. (based upon a drip point tes), which is the current military freeze protection standard. The actual pour point is about −33° C. This property allows for fire-suppressant embodiments which do not require additional freeze suppressants, such as potassium acetate, which while providing freeze protection also erode temperature suppression performance (see FIG. 3).

An additional need in fire suppression is for a low-conductivity liquid that can be used for Class C fires, defined as Class A fires (ordinary combustibles) or Class B fires (flammable liquids and gases) that involve energized electrical equipment. Currently, the options for Class C fires are primarily dry chemical, $CO_2$ and halon extinguishers. We have found, however, that concentrations of sorbitol in the range of 40 to 83% reduce the measured conductivity of water by 5% to 98%, resulting in an aqueous solution that has a conductivity appropriate for fighting Class C fires. (A temperature suppressing composition made according to this invention is also effective for Class A, B and D (combustible metals) fires.)

It is not obvious that sorbitol—or any of the chemical class of compounds known as sugar alcohols and having the general formula $H(HCHO)_{n+1}H$, where n=3 to 11—should be useful in affording some level of protection to personnel and materials from damaging external temperatures experienced as a result of exposure to excessive heat, combustion or explosion. Sorbitol, also called glucitol, with a chemical formula of $C_6H_{14}O_6$, is commonly used in the food and cosmetic industries and has no present use in the fire-suppression industry other than in small amounts as a surfactant, not a humectant, and as an intermediate in the chemical reaction to form fire-resistant polyurethane foam. In forming the foam, however, sorbitol is used as one of several chemical reactants that are subsequently polymerized. In other words, the sorbitol does not remain as sorbitol for use in providing temperature suppression characteristics.

The above test results demonstrate that sorbitol and water provides many useful fire suppression properties that prior art formulations must use a mixture to provide. Because sorbitol provides the heat absorption capability, several components may be removed from these compositions, namely nitrogen or urea, which produces ammonia during combustion, sodium polyacrylate, which produces acrolein during combustion, and the ethanol (listed as a VOC) in which the sodium polyacrylate was dispersed. Removal of these components not only improves the safety and environmental friendliness of the composition, but the simpler formulation of water and sorbitol provides for heat absorption greater than the water alone and sorbitol alone. Furthermore, the simpler formulation allows other positive qualities of sorbitol, such as its char formation and anti-corrosion properties, to be recognized. The char formation characteristics provided by the sorbitol means that additional char formers, like nitrogen, are not necessary. Sorbitol also has unusual heat absorption properties likely based on the fact that it forms extensive hydrogen bonds with water and reduces the freeze point, thereby allowing the sorbitol and water solution to flow at low temperatures. Other fire suppression solutions use salts or glycols to prevent freezing, both of which can be unfriendly and in some cases hazardous to humans.

A preferred embodiment of the composition is listed in Table 1 below. This embodiment contains a viscosity adjusting agent, a wetting agent and an added freeze suppressant. Xanthan gum serves as the viscosity adjusting agent and ammonium lauryl sulfate serves as the foam-former. A wetting agent is important for suppressing a fuel-type fire. Propylene glycol serves as means of both enhancing the flow and depressing the freeze point.

TABLE 1

A Preferred Embodiment of the Fluorocarbon-Free, Halon-Free, Urea-Free Compositions

| Ingredient | Density | Weight (%) | Weight (g) | Volume (ml) |
|---|---|---|---|---|
| Sorbitol | 1.29 | 63.63 | 63.63 | 49.3 |
| Xanthan | 1.50 | 0.10 | 0.10 | 0.1 |
| Ammonium Lauryl Sulfate | 1.04 | 2.24 | 2.24 | 1.7 |
| Propylene Glycol | 1.04 | 1.00 | 1.00 | 0.8 |
| Distilled Water | 1.00 | 33.03 | 33.03 | 25.6 |
| Totals: | | 100.00 | 100.00 | 77.5 |

Table 2 presents another preferred embodiment in which the amount of the wetting agent, ammonium lauryl sulfate, is reduced.

TABLE 2

Another Preferred Embodiment of the Fluorocarbon-Free, Halon-Free, Urea-Free Compositions.

| Ingredient | Density | Weight (%) | Weight (g) | Volume (ml) |
|---|---|---|---|---|
| Sorbitol | 1.29 | 58.10 | 58.10 | 45.0 |
| Xanthan | 1.50 | 0.10 | 0.10 | 0.1 |
| Ammonium Lauryl Sulfate | 1.04 | 1.12 | 1.12 | 0.9 |
| Propylene Glycol | 1.04 | 8.00 | 8.00 | 6.2 |
| Distilled Water | 1.00 | 32.68 | 32.68 | 25.3 |
| Totals: | | 100.00 | 100.00 | 77.5 |

A preservative or biocide may be added to the sorbitol-water composition. In a preferred embodiment, propylene glycol is mixed with xanthan gum and Triclosan to create a slurry before introduction to the sorbitol and water composition. This process ensures that when the xanthan gum and Triclosan are added to the composition they do not clump-up, but instead are able to be added easily to the composition. The Triclosan is added to the composition in order to act as a preservative or biocide to prevent the growth of organisms in the composition over long-term storage. Commercially available wetting agents (e.g., surfactants, foam formers), gels, emulsifiers, viscosity adjusters, flow enhancers, and freeze point suppressants may be added to the water-sugar alcohol composition. Adding a wetting agent in the range of about 3 to 4% of the total quantity of the composition by weight helps in suppressing fuel-type fires because it allows for the composition to float on the surface.

A sorbitol derivative called sorbose, which has a formula $C_6H_{12}O_6$, may be used in combination with a hydrogen donor (like an acid) to derive a sorbitol formula. Alternatively, other sugar alcohols similar in structure to sorbitol —$H(HCOH)_{n+1}H$, where n=5—may be substituted for sorbitol. These sugar alcohols include dulcitol, iditol and mannitol. Furthermore, other sugar alcohols having the general formula $H(HCOH)_{n+1}H$, where n=3 or 4, may be used. These sugar alcohols include erythritol, threitol, arabitol, ribotol, and xylitol. Other sugar alcohols having the general formula $H(HCOH)_{n+1}H$, where n=6 to 11, may also be employed. Still other sugar alcohols having the general formula $H(HCOH)_{+1}HC$, where n=10, may also be used. This group of sugar alcohols includes isomalt, lactitol and maltitol. Last, two or more sugar alcohols may be used in combination or hydrogenated starch hydrolysates, a group of commercial products that contain a broad group of sugar alcohols, may be used.

Table 3 discloses preferred ranges of the components of an organic halide-free temperature suppressing composition made according to this invention and including sorbitol as the at least one sugar alcohol. The ingredients selected from the table below and used in any one embodiment add to 100% of the total. The pour points of these embodiments range between −33 and −63° C., with embodiments including sorbitol in the range of 5 to 11%, xylitol in the range of 2 to 4%, and distilled water in the range of 34 to 41% having the lowest temperature pour point.

TABLE 3

Preferred Ranges of Sorbitol-Based, Flurocarbon-Free, Halon-Free Compositions

| Ingredient | Range Weight % |
|---|---|
| Sorbitol | 4 to 49 |
| Xylitol | 0 to 20 |
| Propylene Glycol | 6 to 15 |
| Potassium Acetate | 0 to 37 |
| Polysorbate 20 | 0 to 4 |
| Aloe Vera | 0 to 7 |
| Distilled Water | 33 to 49 |
| Yucca | 0 to 0.5 |
| Xanthan | 0 to 0.03 |

SUMMARY OF THE PREFERRED EMBODIMENTS

A person of ordinary skill in the art will understand that no non-aqueous solvents are included in the temperature suppressing composition and the sugar alcohol remains as a solubized sugar alcohol during storage and at the moment the composition is deployed from its storage means. In addition to deploying the aqueous temperature suppressing composition from storage means such as fire extinguishers, spray bottles, pumper and hose combinations and the like, piping systems similar to those disclosed in U.S. Pat. Nos. 6,378,617 and 6,612,373 to Brennan may be used. Providing two different sugar alcohols in solution reduces or eliminates the possibility of a portion of the sugar alcohol crystallizing over prolonged periods of storage A person of ordinary skill in the art will also understand and appreciate that all of the temperature suppression compositions disclosed herein are organic halide-free and, specifically, organofluorine-free. (Triclosan is considered to be an organic aromatic compound and not an organic halide. However, because of potential safety concerns with triclosan, it is preferred that the composition not include it given the safety objectives of the invention.) All are halon free, regardless of whether the halon itself is fluorocarbon-free, such as iodomethane (proposed for use by some as a fire extinguishing agent), bromomethane (toxic and regulated as a pesticide), bromochloromethane (banned for use in fire extinguishers), and carbon tetrachloride (a carcinogen). Therefore, a temperature suppressing composition made according to this invention does not have any of the disadvantages typically associated with fluorocarbon-based and halon-based temperature suppressing compositions (see Background section). Further, because no organic halides are included, no "acid" gases are produced. For example, halides like fluorine and chlorine combine with moisture to produce hydrofluoric and hydrochloric acids. A temperature suppressing composition made according to this invention therefore (1) is a fluorocarbon- and halon-free composition which can be applied directly to the skin; (2) can be deployed without resulting in freezing temperatures or requiring a level of force potentially dangerous to people; (3) does not produce acid gas when exposed to high heat and temperature; and (4) is not potentially fatal, harmful, unfriendly or hazardous to humans.

Thus, it is apparent that there has been provided, in accordance with the invention, a composition and process that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the scope of the appended claims.

What is claimed is:

1. A method for suppressing a fire, the method comprising the steps of:

deploying from a storage means a temperature suppressing composition, the temperature suppressing composition being halogen-free and capable of extinguishing a Class D fire and including at least one sugar alcohol in solution with water, the at least one sugar alcohol remaining as a solubilized sugar alcohol at the moment of its deployment from the storage means; and applying temperature suppressing composition to at least one of a physical object at risk and a person at risk because of the fire.

2. A method according to claim 1 wherein the at least one sugar alcohol is a sugar alcohol having a general formula $H(HCHO)_{n+1}H$.

3. A method according to claim 2, "n" is in a range of 3 to 4.

4. A method according to claim 2, "n" is equal to 5.

5. A method according to claim 2, "n" is in a range of 6 to 11.

6. A method according to claim 1, the at least one sugar alcohol is a sugar alcohol having a general formula $H(HCHO)_{n+1}HC$, "n" is equal to 10.

7. A method according to claim 1, the at least one sugar alcohol is in a range of 7 to 70% of the total quantity of the temperature suppressing composition by weight.

8. A method according to claim 1, the at least one sugar alcohol is in a range of 70 to 83% of the total quantity of the temperature suppressing composition by weight.

9. A method according to claim 1, the at least one sugar alcohol is in a range of 65 to 70% of the total quantity of the temperature suppressing composition by weight.

10. A method according to claim 1, the at least one sugar alcohol is in a range of 0.1 to 7% of the total quantity of the temperature suppressing composition by weight.

11. A temperature suppressing composition comprising:

water; and a first and a second sugar alcohol in solution with the water;

the temperature suppressing composition being halo gen-free and having a heat absorption greater than the water alone and the first and second sugar alcohols alone;

the first and second sugar alcohol each being a sugar alcohol having a general formula $H(HCHO)_{n+1}H$, wherein "n" is a different value for the first sugar alcohol than for the second sugar alcohol;

the temperature suppressing composition being substantially instantaneously deployable from a storage means.

12. A temperature suppressing composition according to claim 11, the value of "n" for at least one of the first and second sugar alcohols being in a range of 3 to 4.

13. A temperature suppressing composition according to claim 11, the value of "n" for at least one of the first and second sugar alcohols being equal to 5.

14. A temperature suppressing composition according to claim 11, the value of "n" for at least one of the first and second sugar alcohols being in a range of 6 to 11.

15. A method for suppressing a fire, the method comprising the steps of deploying from a storage means a temperature suppressing composition, the temperature suppressing composition being halogen-free and capable of extinguishing a Class D fire and consisting essentially of at least one sugar alcohol in solution with water, the at least one sugar alcohol remaining as a solubilized sugar alcohol at the moment of its deployment from the storage means; and applying temperature suppressing composition to at least one of a physical object at risk and a person at risk because of the fire.

16. A temperature suppressing composition comprising:

water;

a first sugar alcohol being in solution with the water;

means for preventing crystallization of the first sugar alcohol;

the temperature suppressing composition being halogen-free, the first sugar alcohol in solution with the water having a heat absorption greater than the water alone and the first sugar alcohol alone;

the temperature suppressing composition being substantially instantaneously deployable from a storage means.

17. A temperature suppressing composition according to claim 16, wherein the first sugar alcohol is a sugar alcohol having the general formula $H(HCHO)_{n+1}H$.

18. A temperature suppressing composition according to claim 17, wherein the preventing means is a second sugar alcohol, having a general formula $H(HCHO)_{n+1}H$.

19. A temperature suppressing composition according to claim 18, wherein the first sugar alcohol is a different sugar alcohol than the second sugar alcohol.

20. A temperature suppressing composition according to claim 18, wherein at least one of the first and second sugar alcohols being no greater than about 49% of the total quantity of the temperature suppressing composition by weight.

21. A temperature suppressing composition according to claim 18, wherein at least one of the first and second sugar alcohols being no greater than about 20% of the total quantity of the temperature suppressing composition by weight.

22. A temperature suppressing composition according to claim 16, the temperature suppressing composition being capable of extinguishing a Class D fire.

23. A temperature suppressing composition according to claim 11, the temperature suppressing composition being capable of extinguishing a Class D fire.

* * * * *